US009574155B2

(12) United States Patent
Markovitz et al.

(10) Patent No.: US 9,574,155 B2
(45) Date of Patent: Feb. 21, 2017

(54) LUBRICANT WITH NANODIAMONDS AND METHOD OF MAKING THE SAME

(75) Inventors: Michael Markovitz, Northbrook, IL (US); Guy Verdino, St. Charles, IL (US); Andrey Factor, Farmington Hills, MI (US)

(73) Assignee: NanoTech Lubricants, LLC, Wheeling, IL (US)

( * ) Notice: Subject to any disclaimer, the term of this patent is extended or adjusted under 35 U.S.C. 154(b) by 1417 days.

(21) Appl. No.: 12/491,913

(22) Filed: Jun. 25, 2009

(65) Prior Publication Data

US 2010/0029518 A1 Feb. 4, 2010

Related U.S. Application Data

(60) Provisional application No. 61/077,694, filed on Jul. 2, 2008.

(51) Int. Cl.
*C10M 125/02* (2006.01)
*C10M 141/00* (2006.01)

(52) U.S. Cl.
CPC ..... *C10M 125/02* (2013.01); *C10M 141/00* (2013.01); *C10M 2201/02* (2013.01); *C10M 2201/041* (2013.01); *C10N 2220/022* (2013.01); *C10N 2220/082* (2013.01); *C10N 2230/06* (2013.01); *C10N 2240/04* (2013.01); *C10N 2240/08* (2013.01); *C10N 2240/10* (2013.01); *C10N 2270/00* (2013.01)

(58) Field of Classification Search
CPC ..... C10M 125/02; C10M 141/00; C10M 2201/02; C10M 2201/041; C10N 2220/022; C10N 2220/082; C10N 2230/06; C10N 2240/04; C10N 2240/08; C10N 2240/10; C10N 2270/00
USPC ..... 366/108; 508/113
See application file for complete search history.

(56) References Cited

U.S. PATENT DOCUMENTS

| | | | | |
|---|---|---|---|---|
| 4,249,347 | A | 2/1981 | Bura et al. | |
| 5,158,695 | A | 10/1992 | Yashchenko et al. | |
| 5,614,477 | A | 3/1997 | Kompan et al. | |
| 5,916,955 | A | 6/1999 | Vereschagin et al. | |
| 6,419,717 | B2 | 7/2002 | Moy et al. | |
| 6,432,320 | B1 | 8/2002 | Bonsignore et al. | |
| 6,695,974 | B2 | 2/2004 | Withers et al. | |
| 6,858,157 | B2 | 2/2005 | Davidson et al. | |
| 7,216,661 | B2 | 5/2007 | Welty et al. | |
| 7,300,958 | B2 | 11/2007 | Kataoka et al. | |
| 7,390,428 | B2 | 6/2008 | Davidson et al. | |
| 2003/0107948 | A1* | 6/2003 | Jacob | 366/181.4 |
| 2003/0151030 | A1 | 8/2003 | Gurin | |
| 2004/0069454 | A1 | 4/2004 | Bonsignore et al. | |
| 2004/0121919 | A1* | 6/2004 | Gao | 508/363 |

(Continued)

FOREIGN PATENT DOCUMENTS

| | | |
|---|---|---|
| EP | 1 052 307 | 11/2000 |
| EP | 1 783 389 | 5/2007 |

(Continued)

*Primary Examiner* — James Goloboy
(74) *Attorney, Agent, or Firm* — Hansen IP Law PLLC

(57) ABSTRACT

A lubricating composition and method of making the same are provided. The lubricating composition comprises a lubricant fluid, water, and carbon nanoparticles comprising nanodiamonds. The method comprises mixing the lubricating composition under high shear followed by ultrasonication.

1 Claim, 9 Drawing Sheets

(56) References Cited

U.S. PATENT DOCUMENTS

| | | | | |
|---|---|---|---|---|
| 2004/0206941 | A1 | 10/2004 | Gurin | |
| 2004/0209782 | A1 | 10/2004 | Zhang et al. | |
| 2005/0012069 | A1 | 1/2005 | Maes et al. | |
| 2005/0047271 | A1* | 3/2005 | Kozyuk | 366/172.2 |
| 2005/0124504 | A1 | 6/2005 | Zhang et al. | |
| 2005/0151114 | A1 | 7/2005 | Davidson et al. | |
| 2005/0175769 | A1 | 8/2005 | Kunugi et al. | |
| 2007/0108009 | A1 | 5/2007 | Ando et al. | |
| 2007/0158609 | A1 | 7/2007 | Hong et al. | |
| 2007/0158610 | A1* | 7/2007 | Hong et al. | 252/71 |
| 2007/0253888 | A1 | 11/2007 | Liu et al. | |
| 2007/0254817 | A1 | 11/2007 | Griffo et al. | |
| 2008/0248979 | A1* | 10/2008 | Nakagawa et al. | 508/128 |
| 2009/0018037 | A1* | 1/2009 | Mabuchi et al. | 508/165 |
| 2011/0003721 | A1 | 1/2011 | Hong | |

FOREIGN PATENT DOCUMENTS

| | | |
|---|---|---|
| JP | 2003/062799 | 3/2003 |
| JP | 2003/206120 | 7/2003 |
| JP | 2004/277684 | 7/2004 |
| JP | 2006/241277 | 9/2006 |
| JP | 2006241443 A * | 9/2006 |
| JP | 2007/308351 | 11/2007 |

* cited by examiner

LUBRICANT WITH NANODIAMONDS AND METHOD OF MAKING THE SAME

CROSS-REFERENCE TO RELATED APPLICATIONS

This application claims the benefit of U.S. Provisional Patent Application No. 61/077,694, filed on Jul. 2, 2008, the entire contents of which are hereby incorporated by reference.

TECHNICAL FIELD

The disclosure generally relates to lubrication, and more specifically to anti-wear lubricants, and in particular, lubricant compositions that include a dispersion of nanodiamonds.

BACKGROUND

Conventional anti-wear lubricants rely on additives containing elements that combine with the rubbing surfaces (usually iron or some other metal) and the resulting metal salt, i.e., iron phosphate, acts to separate the rubbing surfaces at the microscopic level. The metallic compounds have melting points and frictional values that allow the rubbing surfaces to move over one another without catastrophic failure either at the microscopic or macroscopic level. Recently, the levels of the main anti-wear chemical in the lubrication industry, zinc dialkyldithiophosphate (ZDP or ZDDP), have been used at lower levels for various reasons (poisoning of catalytic converters in automotive exhaust systems or waste treatment facilities of manufacturers that use hydraulic oils containing ZDDP). Further, it is not an uncommon experience that car and machinery owners do not always maintain their equipment on a timely basis, when they should be all the more vigilant due to the minimal anti-wear contents of their present day lubricants.

As discussed herein, the present disclosure relates to the use of lubricating compositions that include carbon nanoparticles comprising nanodiamonds. Nano sized particles (i.e, particles on the order of $1\text{-}100\times10^{-9}$ m) have been proposed for a variety of applications in which they are to be mixed with fluids. However, the particles tend to agglomerate and clump together and otherwise resist the formation of a uniform and homogeneous dispersion in the fluid. In addition, the nanoparticles can cause the formation of regions of electrical charge which may be undesirable. Thus, a need has arisen for a lubricant composition and method of making the same which overcomes the foregoing challenges.

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

DETAILED DESCRIPTION

Figure 1:
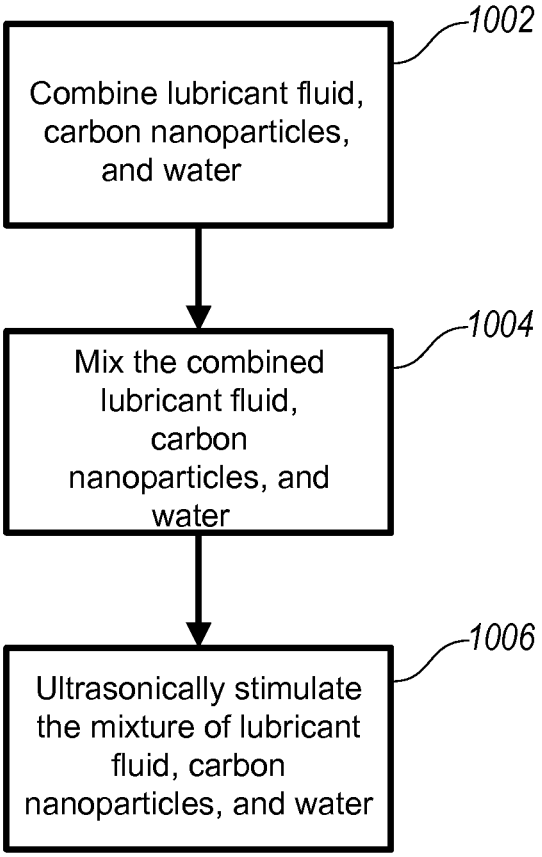
FIG. 1 is a flow diagram of a first embodiment of a method for preparing a nanodiamond lubricant composition.

Described herein is a lubricant composition that comprises a lubricant fluid, carbon nanoparticles comprising nanodiamonds, and water. The term "nanoparticles" refers to particles of a size that is generally less than about 100 nm (i.e. $10\times10^{-9}$ m). Carbon nanoparticles may take a variety of forms, including graphite, fullerenes/buckyballs, and nanotubes. However, the carbon nanoparticles comprising the lubricant composition preferably include nanodiamonds, which are formed of networks of carbon atoms bonded together in a tetrahedral arrangement.

Suitable lubricating fluids include lubricious liquids, preferably non-polar, hydrocarbon liquids comprising molecules that include from 4-60 carbons, preferably from about 8-50 carbons, and more preferably from about 12-40 carbons. Suitable lubricating fluids include synthetic and natural oils, both naphthenic and paraffinic, and preferably include lubricating oils based on the American Petroleum Institute ("API") Base Stocks Group I, Group II, Group III, and Group IV. As is known in the art, the API sets minimum performance standards for lubricants. Lubricant base stocks are categorized into five groups by the API. Group I base stocks are composed of fractionally distilled petroleum which is further refined with solvent extraction processes to improve certain properties such as oxidation resistance and to remove wax. Group II base stocks are composed of fractionally distilled petroleum that has been hydrocracked to further refine and purify it. Group III base stocks have similar characteristics to Group II base stocks, except that Group III base stocks have higher viscosity indexes. Group III base stocks are produced by further hydrocracking Group II base stocks or hydroisomerized slack wax, (a byproduct of the dewaxing process). Group IV base stocks are polyalphaolefins (PAOs). Group V is a catch-all group for any base stock not described by Groups I to IV. Examples of group V base stocks include polyol esters, natural esters from seed oils and synthetic fatty esters. The lubricating fluid may also include a lubricating ester such as polyol esters, natural esters from seed oils and synthetic fatty esters, viscosity index improvers, or combinations thereof. Exemplary lubricating fluids include SAE Engine oils with SAE viscosity grades of 5W, 10W, 20, 30, 40 and 50. In certain preferred examples of the lubricating compositions described herein, the lubricant fluid preferably has a kinematic viscosity (viscosity/density) at 40° C. that is preferably from about 15 cSt to about 800 cSt and more preferably from about 20 cSt to about 350 cSt. Other examples include SAE Gear Oils with SAE viscosity grades 75W, 80W, 85W, 90 and 140.

As mentioned above, the carbon nanoparticle component of the lubricating composition preferably includes nanodiamonds (also referred to as "ultradispersed diamonds" or "UDD"). One method of making nanodiamonds is known as "detonation synthesis," a process that employs charges of explosive substances which are detonated in high strength round hermetically sealed chambers. In one exemplary process, diamond particles are formed from the free carbon of the molecules of the explosives at temperatures of approximately 3,500° C. and at pressures of approximately 200,000 atmospheres. The detonation chambers are equipped with mechanized loading/unloading systems for handling the explosive substances and the detonation products, cooling systems, hydraulically operated access hatches and related supplementary equipment. Details of detonation synthesis processes are provided in Vereschagin, et al., U.S. Pat. No. 5,916,955, the entirety of which is hereby incorporated by reference. The detonation synthesis produces carbon nanoparticles that include nanodiamonds and other forms of carbon, such as graphite. Thus, subsequent purification steps may be used to increase the nanodiamond purity. The carbon nanoparticle component of the lubricating compositions described herein generally has at least about 60% nanodiamonds by weight of the total amount of carbon nanoparticles. A nanodiamond content of at least about 70% by weight is more preferred, and a nanodiamond content of at least about 80% is even more preferred. A nanodiamond content of at least about 90% by weight is most preferred. Commercially available nanodiamonds are sometimes supplied with the designation "UDD-X" wherein X represents the percentage of diamonds in a carbon nanoparticle material. Thus, a designation of UDD-90 refers to a carbon nanoparticle composition with a nanodiamond content of about 90% by weight.

The nanodiamonds used herein generally are less than 100 nm in size and are preferably less than about 20 nm in size. Sizes of less than 10 nm are more preferable, and in an especially preferred embodiment, sizes ranging from about 4 nm to about 6 nm are used.

Without wishing to be bound by any theory, one benefit of including nanodiamonds in the lubricant composition is believed to be their ability to separate metal surfaces at the microscopic and perhaps nanoscopic level and that the nanodiamonds, by sliding over themselves without allowing the metal asperities to rub and heat up to the point of welding to each other, reduce overall friction. The content of carbon nanoparticles in the lubricating compositions described herein is generally sufficient to produce a desired degree of friction reduction and is preferably from about 10 ppm to about 500 ppm by weight of the lubricant composition. A carbon nanoparticle content of from about 20 ppm to about 400 ppm is more preferred, and a carbon nanoparticle content of from about 30 ppm to about 200 ppm by weight is even more preferred. A carbon nanoparticle content of from about 40 ppm to about 105 ppm is especially preferred.

Nanodiamonds can be difficult to incorporate in a lubricant fluid, in particular, non-polar hydrocarbon liquids such as commercially available lubricating oils, because they tend to agglomerate and resist the formation of a uniform dispersion in the fluid. As will be described in greater detail below, it has been found that the addition of water facilitates the dispersion of nanodiamonds in the lubricant fluid and beneficially reduces the nanodiamond content that is required to produce a desired reduction in friction. Without wishing to be bound by any theory, it is believed that the water enters into the layers of lubricating composition being squeezed between frictionally engaged surfaces and enhances the friction-reducing activity of the nanodiamonds.

The amount of water is generally sufficient to aid in providing a homogeneous dispersion of the carbon nanoparticles and aid in friction reduction while being low enough to prevent the mixture from becoming hazy and unemulsified. The amount of water in the lubricant composition is preferably from about 200 ppm to about 2000 ppm by weight of the lubricant composition and is more preferably from about 250 ppm to about 1600 ppm. A water content of from about 300 ppm to about 1200 ppm is even more preferred, and a water content of from about 350 ppm to about 800 ppm is especially preferred.

As indicated above, nanodiamonds can be difficult to incorporate into many lubricant fluids. It has been found that a method which incorporates both high shear mixing and ultrasonic dispersion (also referred to as "ultrasonication") can be used to provide a substantially homogeneous dispersion of the nanoparticles in the lubricant fluid. "High shear" refers generally to shear rates (e.g., velocity gradients) of above 1,000 $sec^{-1}$. Shear rates above 5,000 $sec^{-1}$ are preferred, and shear rates above 10,000 $sec^{-1}$ are more preferred. Shear rates above 20,000 $sec^{-1}$ are most preferred, and shear rates above 50,000 $sec^{-1}$ are especially preferred. In certain exemplary embodiments, twin post stator-rotor mixers (e.g., Silverson and Ultraturrax mixers) are used to provide high shear mixing and are capable of producing shear rates up to 100,000 $sec^{-1}$.

An embodiment of a method of making a lubricant composition comprising nanodiamonds is illustrated in FIG. 1. In accordance with the method, a volume of carbon nanoparticles comprising nanodiamonds is provided. The nanodiamond content of the carbon nanoparticles is that described previously. The carbon nanoparticles are combined with a lubricant fluid of the type described above and with water (step 1002) in the relative amounts described above. In one embodiment, they are combined in a mixing vessel to define a mixture precursor. The mixture precursor is then subjected to high shear mixing (step 1004) using a rotating agitator that rotates at a selected rate (RPM) for a selected period of time to achieve a desired degree of mixing. The agitation rate is preferably from about 5,000 rpm to about 20,000 rpm, more preferably from about 6,000 rpm to about 15,000 rpm, and even more preferably from about 7,000 rpm to about 12,000 rpm, with an agitation rate of from about 9,000 rpm to about 11,000 rpm being most preferred. In one exemplary illustration, an agitation rate of about 10,000 rpm is used. As will be explained below, the mixing is preferably performed using a high shear mix head that is configured to shear the lubricant composition into particles of a desired size as it mixes. When samples drawn up from the mixture no longer contain particles visible to the naked eye, the mixture is ready to move on to the ultrasonication step.

In one exemplary implantation, a twin post rotor/stator mixer with a 0.33 hp motor and a maximum theoretical RPM of 8,000 is used to provide high shear mixing of up to 3 gallons of lubricating composition. In another exemplary implementation, a twin post rotor/stator mixer with a 1.5 hp motor and a maximum theoretical RPM of 3600 is used to provide high shear mixing of 60 gallons of lubricating composition. In yet another exemplary implementation, a twin post rotor/stator mixer with a 15 hp motor is used to provide high shear mixing of 475 gallons of lubricating composition.

The mixing time ranges generally from about 1 minute to about 60 minutes, with a mixing time ranging from about 5 minute to about 45 minutes being preferred, and a mixing time ranging from about 10 minutes to about 30 minutes being more preferred. The mixing device preferably operates at a ratio of power/mixing volume that ranges from 0.01 hp/gal to about 0.5 hp/gal, with a ratio of from about 0.025 hp/gal to about 0.25 hp/gal being more preferred, and a ratio of from about 0.05 hp/gal to about 0.15 hp/gal being especially preferred.

The use of high shear mixing produces a temperature increase in the lubricant composition that is dependent on the rate of agitation and composition. In one exemplary embodiment, the temperature increases from room temperature to a temperature ranging from about 75° F. to about 135° F. In certain preferred examples, the high shear mixing step produces a vortex in the lubricant fluid which draws the otherwise "fluffy" nanoparticles down into the fluid where it can be wetted out.

In step 1006, the mixture of lubricant fluid, carbon nanoparticles, and water is subjected to ultrasonication (i.e., stimulation of the lubricant composition at ultrasonic frequencies) for a period of time and at one or more frequencies and at one or more amplitudes that are sufficient to yield a substantially homogeneous mixture of carbon nanoparticles, lubricant fluid, and water. In certain examples, the frequencies and/or amplitudes are user-selected. Preferably, there are no observable particles collected at the bottom or on the sides of the mixing vessel at the completion of the ultrasonication step. Moreover, it is preferred that no particles are observable at a magnification of about 10×.

The ultrasonication frequency or frequencies preferably range from about 5 kHz to about 100 kHz. Frequencies ranging from about 10 kHz to about 50 kHz are more preferred, and frequencies ranging from about 15 kHz to about 30 kHz are especially preferred. In one example, a frequency of 20 kHz is used. The ultrasonication is preferably carried out one or more times for durations ranging from about 1 minute to about 60 minutes. Durations of 5 minutes to 30 minutes are more preferred, and durations of about 10 minutes are especially preferred. If the lubricating composition is intended for immediate use, one (1) ultrasonication is generally sufficient. However, if a longer shelf life is required, additional repetitions of the ultrasonication may be required. In one example where the lubricating composition will be supplied to distributors, the ultrasonication step is performed twice.

The amplitude of the ultrasonication preferably ranges from about 10 microns to about 100 microns, with amplitudes ranging from about 15 microns to about 40 microns being more preferred, and amplitudes ranging from about 20 microns to about 30 microns being especially preferred. In one example, a 25 micron amplitude is used. The ultrasonication of the lubricant composition produces a temperature rise that generally ranges from about 5° F. to about 60° F. and preferably from about 10° F. to about 400° F., with a temperature rise of from about 15° F. to about 25° F. being more preferred, and a temperature rise of about 20° F. being especially preferred. In one exemplary embodiment, the temperature of the lubricant composition is increased from about 120° F. to about 140° F. during the ultrasonication step. The ultrasonication is preferably carried out in a manner that causes acoustic cavitation to occur within the lubricating composition. In certain preferred embodiments, following ultrasonication the lubricating composition is substantially resistant to the precipitation/separation of carbon nanoparticles from the mixture. If desired, a chemical dispersant and/or detergent may also be used to facilitate mixing. One suitable detergent/dispersant is Afton Hitec 637.

In addition, a lubricant concentrate can be produced which is subsequently diluted by adding additional lubricant fluid. In one embodiment, a lubricating fluid is combined with from about 800 ppm to about 20,000 ppm of carbon nanoparticles comprising nanodiamonds and from about 3,200 ppm to about 50,000 ppm of water, and optionally from about 50,000 ppm to about 500,000 ppm of a chemical detergent/dispersant. The combined ingredients are mixed under high shear and ultrasonicated as described previously. The concentrate is then stored and subsequently diluted with additional lubricant fluid which is added in a ratio ranging from about 800:1 to about 100:1 (lubricant fluid:concentrate).

In one preferred implementation of the method of FIG. 1, the lubricant fluid is provided in a vessel and agitated at a low speed sufficient to create a small vortex without drawing air into the fluid, and the water and carbon nanoparticles are added to it. Agitation rates range from about 100 RPM to 5000 RPM with 1000 to 4000 being more preferable and 2000 to 3000 RPM being most preferred. In one embodiment, a 15W50 motor oil is agitated at 2500 RPM and the nanodiamonds are drawn into the vortex without air also being drawn in, until the nanodiamonds are sufficiently wetted. The agitation rate is then increased to the rates described above with respect to step 1004 in FIG. 1. The carbon nanoparticles may be added before or after the water.

Figure 2:
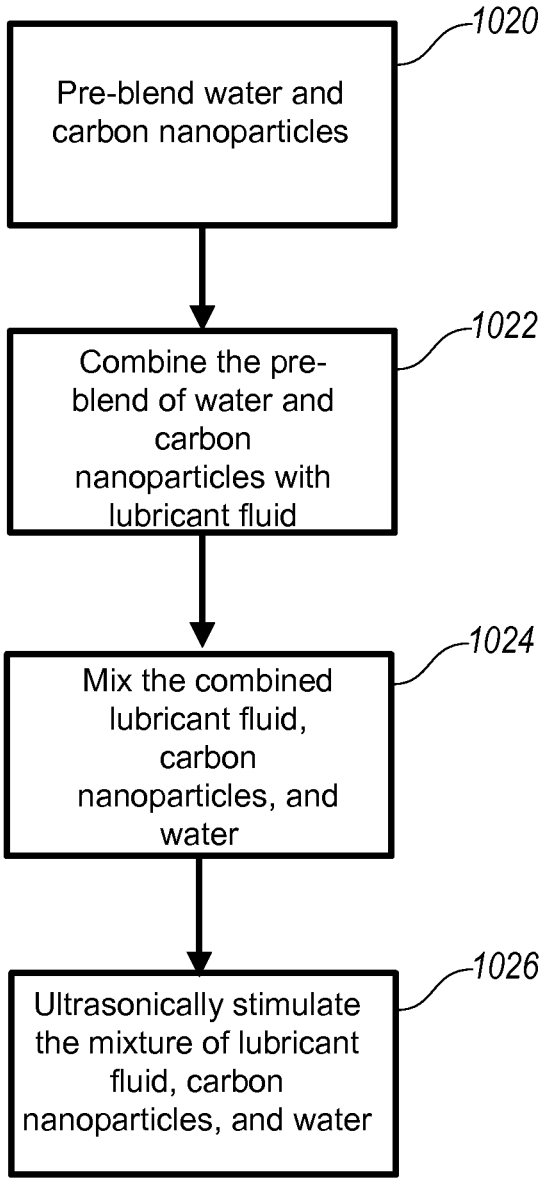
FIG. 2 is a flow diagram of a second embodiment of a method for preparing a nanodiamond lubricant composition.

In another exemplary embodiment, illustrated in FIG. 2, the water and carbon nanoparticles are pre-mixed and the pre-mix is then combined with the lubricant fluid. In step 1020, water and carbon nanoparticles are pre-blended in amounts that are selected to provide the desired amounts in the finished lubricant composition, as described above. The pre-blending step may be performed using high shear mixing and/or ultrasonication. However, in one exemplary embodiment, the water and carbon nanoparticles are mixed using high shear mixing and are then ultrasonicated until a substantially homogeneous dispersion of water and diamonds is obtained. In step 1022, the pre-blended combination of water and carbon nanoparticles are combined with a lubricant fluid. The combination is then mixed using high shear mixing at the agitation rates and times described above (step 1024). The combination of lubricant fluid, water, and nanodiamonds is then ultrasonicated as described previously (step 1026) until a substantially homogeneous mixture is observed.

When substantially complete mixing of the lubricating composition is obtained at a carbon nanoparticle level of from about 60 ppm to about 100 ppm, a green hue typically appears in the lubricant, whereas at a carbon nanoparticle level of from about 800 ppm to about 10,000 ppm, a black hue appears. At lower levels of carbon nanoparticles, such as from about 10 ppm to about 50 ppm, there is little observable tinting of the lubricating composition. In the embodiments discussed above, high shear mixing and ultrasonication are performed once. However, each step may be repeated a number of times as needed to achieve a desired result. In addition, both high shear mixing and ultrasonication may be simultaneously carried out and are not limited to sequential application.

Figure 3:
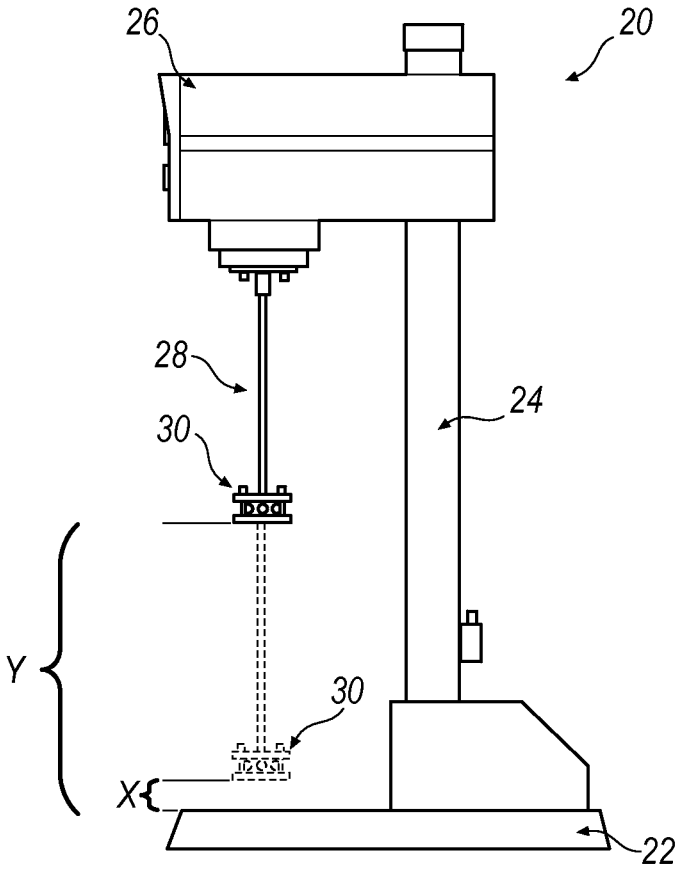
FIG. 3 is a side elevation view of a high shear mixer used to illustrate an embodiment of a method of preparing a nanodiamond lubricant composition.

The methods of FIGS. 1 and 2 may be implemented in batch, semi-batch, and continuous processes and using a variety of equipment. One embodiment of a high shear mixer is a laboratory scale mixer supplied under the name L4RT by Silverson Machines, Ltd. as depicted in FIG. 3. The high shear mixer 20 comprises a base 22, a vertical support 24, and a motor housing 26. A motor (not shown) is housed in motor housing 26 and is operatively connected to rotating shaft 28 which rotates about its longitudinal axis. Rotating shaft 28 is operatively coupled to a motor (not shown) disposed in motor housing 26 on one end and to a rotor (not shown) disposed within high shear mixing head 30 on its other end. As depicted in FIG. 3, motor housing 26 is preferably capable of being moved vertically along vertical support 24 to allow the vertical position of high shear mixing head 30 to be adjusted. In FIG. 3, mixing head 30 is shown at a first position at which it is spaced apart from base 22 by a distance Y and at a second position (in broken lines) at which it is positioned at a smaller distance X from base 22. Thus, when a mixing vessel is placed on the upward facing surface of base 22, high shear mixing head can be lowered beneath the liquid level of the mixing vessel to facilitate mixing.

Figure 4A:
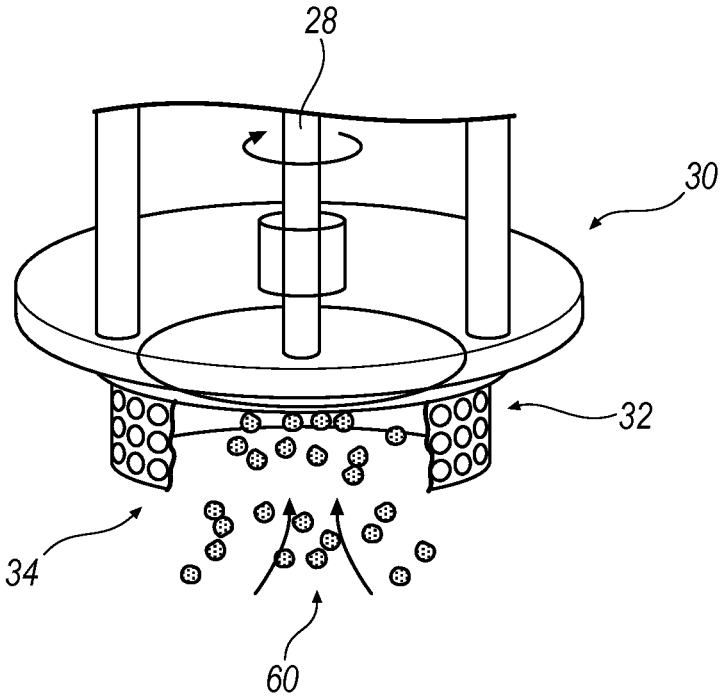
FIG. 4*a* is an embodiment of a high shear mixing head used with the mixer of FIG. 3 and illustrating a first stage of operation.
Figure 4B:
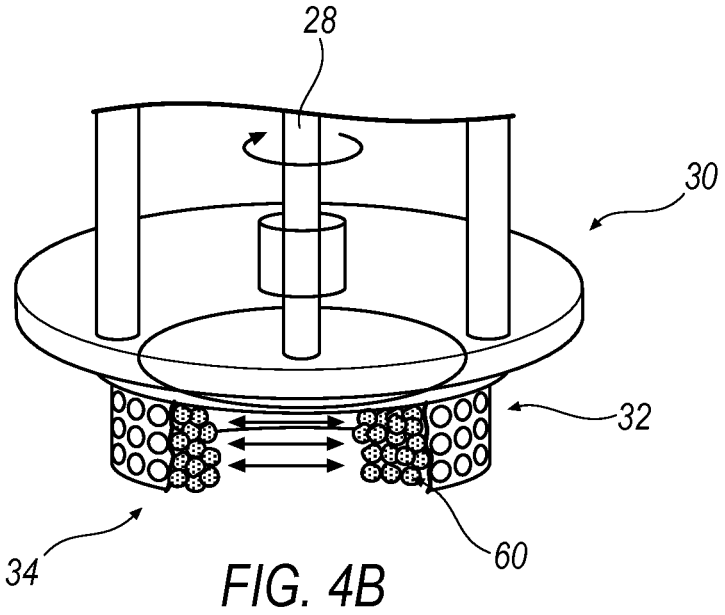
FIG. 4*b* depicts the high shear mixing head of FIG. 4*a* in a second stage of operation.
Figure 4C:
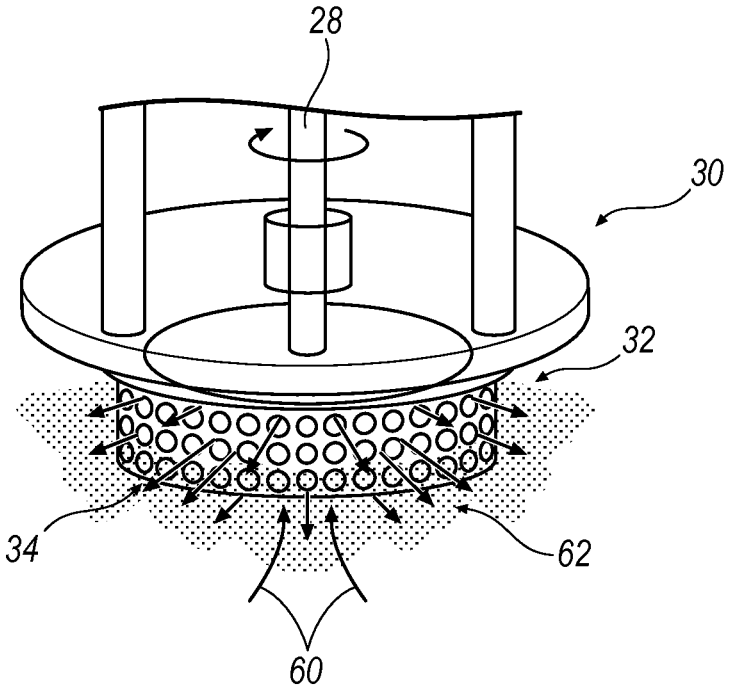
FIG. 4*c* depicts the high shear mixing head of FIG. 4*a* in a third stage of operation.
Figure 4D:
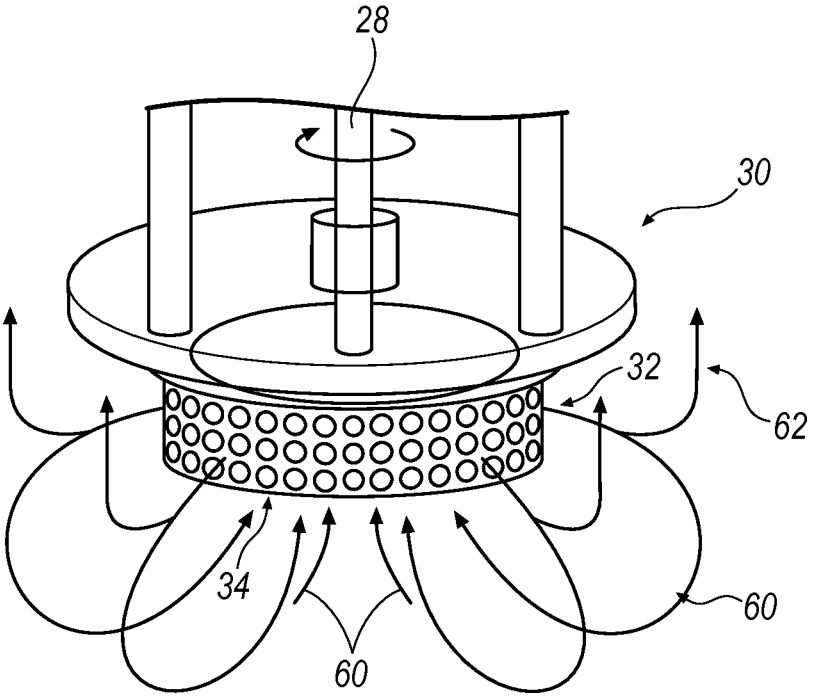
FIG. 4*d* depicts the high shear mixing head of FIG. 4*a* and illustrates the simultaneous processing of different liquid volumes undergoing the processing stages depicted in FIGS. 4*a*-4*c;*

The operation of high shear mixing head 30 can be described by reference to three (4) mixing stages which are illustrated in FIGS. 4*a*-4*c*. The stages represent the sequential processing of a volume of liquid within high shear mixing head 30. In the figures, high shear mixing head 301 is inserted into a mixing vessel beneath the level of the liquid. Referring to FIG. 4*a*, high shear mixing head 30 includes a stator 32 and a rotor (not shown). In FIG. 4*a*, a portion of stator 32 has been removed for illustration purposes to show the fluid flow in the interior of stator 32. As indicated in the figure, the rotation of the rotor via shaft 28 causes the creation of a vortex that draws fluid 60 into the bottom open area of stator 32 (see also FIGS. 5*a* and 5*b*). As shown in FIG. 4*b*, fluid 60 is then propelled against the inner surface of stator 32 and ultimately through openings 35, 37 (FIGS. 5*a* and 5*b*) in stator. The openings 35, 37 are sized to shear the liquid passing through stator 32 into a desired size that facilitates the mixing process. In FIG. 4*c*, sheared fluid 62 is seen exiting stator 32 back into the body of fluid. FIG. 4*d* illustrates the simultaneous entry of unsheared fluid 60 into stator 32 and discharge of sheared fluid 62 from stator 32.

Figure 5A:
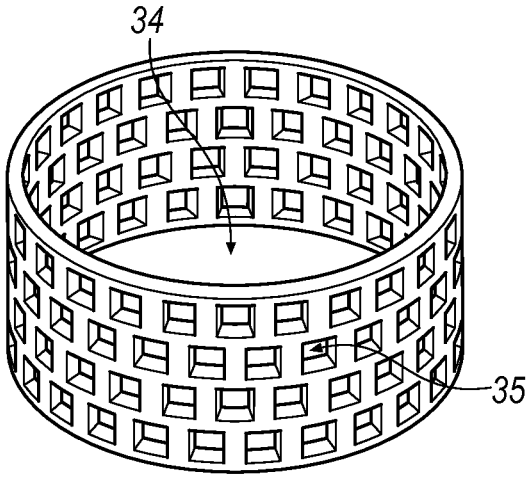
FIG. 5*a* is a first embodiment of a stator used in a high shear mixing head.
Figure 5B:
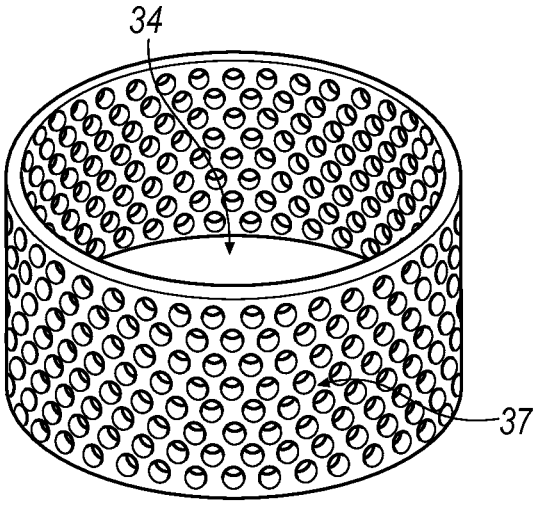
FIG. 5*b* is a second embodiment of a stator used in a high shear mixing head.

Stator 32 is preferably a substantially rigid cylindrical structure that is sized to accommodate the rotors of high shear mixer 20. Stator preferably has a plurality of openings, which in FIG. 5*a* are polygonal openings 35. Polygonal openings 35 may have a variety of shapes including square, rectangular, triangular, trapezoidal, etc. In FIG. 5*b*, openings 37 are round and may be elliptical, oval, or circular. However, square openings are preferred.

Figure 6:
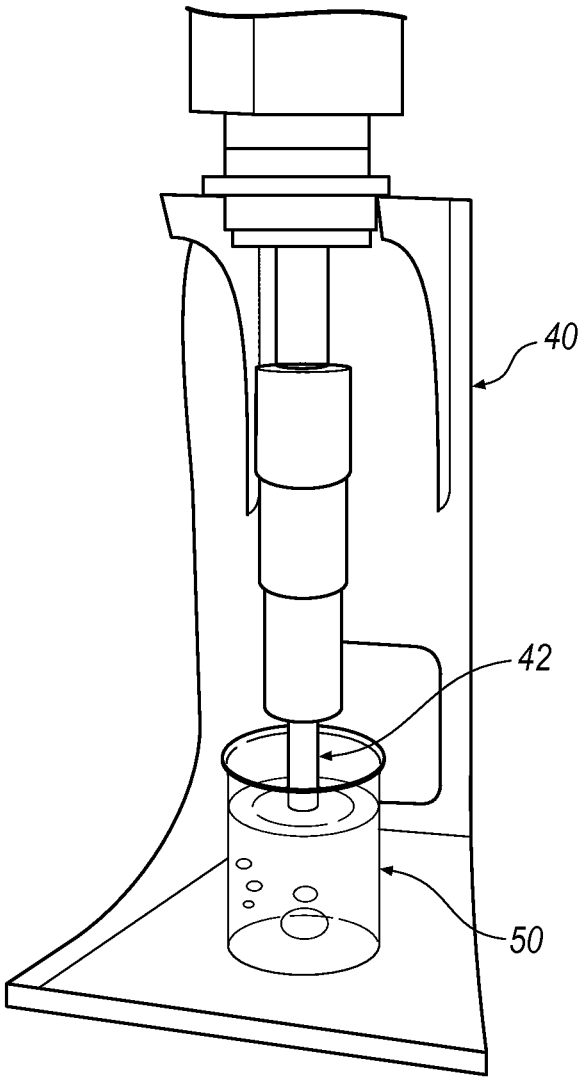
FIG. 6 is a first embodiment of an ultrasonic dispersing unit.

A first embodiment of an ultrasonicating device 40 is depicted in FIG. 6. Ultrasonic probe 42 is configured to vibrate at ultrasonic frequencies and is inserted beneath the level of the lubricating composition in mixing vessel 50. One embodiment of an ultrasonicating device is the UIP 1000, a 1000 Watt, 20 kHz ultrasonic processor supplied by Hielscher USA, Inc.

Figure 9:
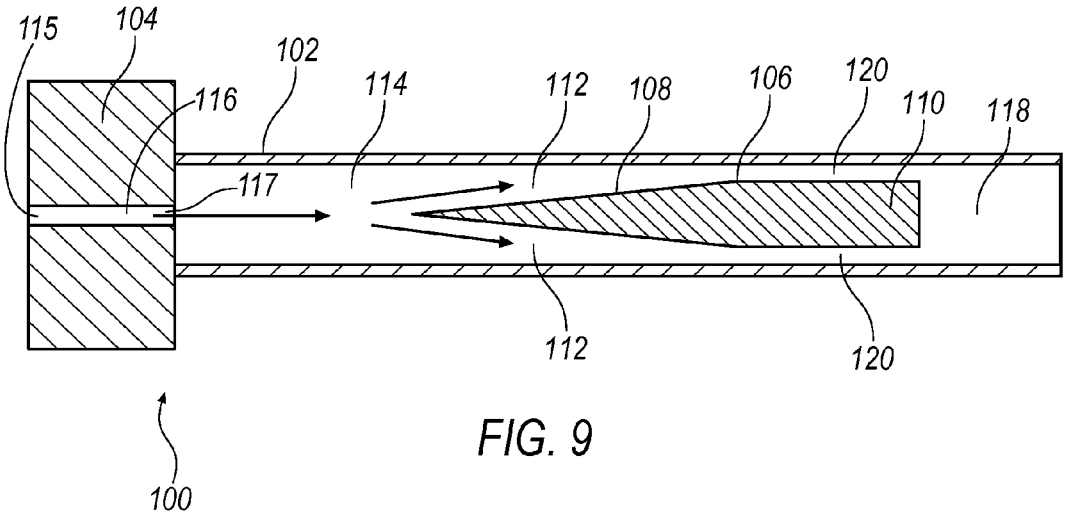
FIG. 9 is a second embodiment of an ultrasonic dispersing unit.

A second embodiment of an ultrasonicating device 40 is an in-line homogenizer 100 depicted in FIG. 9. In-line homogenizer 100 comprises a conduit 102 with a slotted orifice 104 and baffle 106 disposed therein. The mixture of lubricant fluid, carbon nanoparticles, and water is fed to homogenizer 100 at inlet 115 and flows through orifice conduit 116. The mixture is discharged from orifice 104 at orifice outlet 117. The cross-sectional profile of orifice conduit 116 may have a variety of different profiles in the direction normal to the fluid flow, including ovular, circular, polygonal, etc. However, in one preferred example, the cross-sectional profile normal to the fluid flow direction is generally rectangular. An commercially available example of an in-line homogenizer with this baffle geometry is the Sonolator, which is supplied by the Sonic Corporation.

The use of slotted orifice 104 causes the mixture to discharge at outlet 117 at a high velocity. The mixture flows through conduit section 114 and then contacts baffle 106 and flows around it through flow passages 112 and 120. As the mixture flows at a high speed and contacts the baffle 106, ultrasonic cavitation occurs, further mixing the combination of nanoparticles, water, and lubricant fluid. The fluid ultimately reaches a conduit location 118 distal of baffle 106 and is discharged for subsequent storage.

Baffle 106 may have a number of sizes and shapes. However, it preferably comprises a proximal section 108 and a distal section 110 having different shapes. In one example, proximal section 108 is conical. In another example, proximal section 108 is in the shape of a wedge. In one example, distal section 110 is cylindrical, and in another example distal section 110 is in the shape of a rectangular block. In a preferred example, proximal section 108 is in the shape of a wedge that increases in thickness moving along conduit 102 from the portion proximal slotted orifice 104 to the portion that is distal from slotted orifice 104, and distal section 110 is in the shape of a rectangular block.

In one example, the fluid pressure exerted against baffle proximal section 108 is generally from about 50 to about 40,000 psi, preferably from about 500 psi to about 20,000 psi, more preferably from about 1,000 psi to about 4,000 psi, and even more preferably from about 1,500 to about 2,500 psi.

Figure 8:
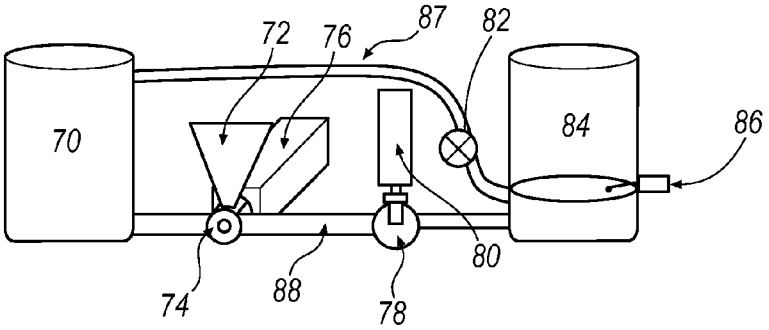
FIG. 8 is an embodiment of a continuous flow process for making a nanodiamond lubricant.

As indicated previously, the methods of FIGS. 1 and 2 can also be implemented in a semi-batch process such as the embodiment depicted in FIG. 8. Lubricant fluid vessel 70 maintains a desired volume of the lubricant fluid component of the lubricating composition. The lubricant fluid flows from vessel 70 into process pipe 88 where it flows through high shear mixing head 74. High shear mixing head 74 is preferably a rotor/stator type mixing head, an example of which is depicted in FIGS. 4*a*-4*d*.

Carbon nanoparticle supply/injector 72 has a volume of nanoparticles and water that are pre-blended in relative amounts that are based on the desired composition of the finished product. In one illustrative implementation, the pre-blending is conducted in a lab scale mixer such as a high shear Silverson L4RT mixer in about 5 gallon increments which can be used to produce from about 4,000 gallons to about 5,000 gallons of finished lubricating composition. The carbon nanoparticles/water pre-mixture is then injected into mix head 74 where it mixes with the lubricant fluid from vessel 70. After high shear mixing in head 74, the mixture flows to flow chamber 78 in which an ultrasonic probe from ultrasonic generator 80 is inserted. The ultrasonic probe is vibrated at one or more selected frequencies and at one or more selected amplitudes to achieve the desired degree of mixing. Fluid discharged from flow chamber 78 is then directed into recovery and recirculation vessel 84. During a first phase of operation, transfer circulation pump 82 is operated to recycle the mixed and ultrasonicated product back to vessel 70 via recycle line 87. Samples are periodically drawn from recovery and circulation vessel 84 to determine if the product is sufficiently mixed and homogeneous as determined by visual observation. Once an acceptable is observed, product may be drawn off from recovery and circulation vessel using a product discharge hydraulic circuit (not shown). As indicated in FIG. 8, a level switch 86 may be provided to activate transfer circulation pump 82 when the level in recovery and recirculation vessel 84 reaches a selected level. In addition, a control valve may be provided in recycle line 87 and a level controller may be used to adjust the control valve to control the flow rate through recycle line 87 to control the level in vessel 84. If a product discharge hydraulic circuit is provided, it may also have a control valve that controls the flow of product from the system and which is used to control the level in vessel 84.

The lubricating compositions described herein may be used to lubricate surfaces that frictionally engage one another by applying or flowing the composition between the surfaces, thereby reducing the degree of friction exerted by one surface on the other. In gear assembly applications, the lubricating composition may be applied between the engaged teeth of adjacent gears to reduce the level of frictional contact therebetween. In vehicle applications, the vehicle lubrication system may be charged with the lubricating composition. The lubricating composition has a variety of vehicle applications, including as an engine oil, gear oil, transmission fluid, differential fluid, power steering fluid, and hydraulic tractor fluid.

EXAMPLE 1

A base oil consisting of a commercial synthetic 5W30 motor oil, is poured into a mixing vessel and is agitated at a low speed of about 2200 RPM using a Silverson L4RT high shear laboratory mixer. UDD-90 nanodiamonds (e.g., carbon nanoparticles comprising 90% by weight nanodiamonds) are added to the vessel and the agitation rate is adjusted to 9400 RPM and is held at that rate for 25 minutes. During that time, the RPM increased from about 9400 to about 10,200 RPM due to internal heating. The carbon nanoparticles are added in an amount that is 104.9 ppm by weight of the total composition. Following high hear shear mixing, the vessel is transferred to a Hielscher UIP1000 ultrasonic processor and is ultrasonicated at a frequency of 20 kHz and an amplitude of 25 microns for 15 minutes. Following ultrasonication, no observable particles are present in a sample of the mixture drawn up into a glass pipette and no nanodiamonds are observed settling out onto the bottom of the mixing vessel. The product is the dark green color typical of this level of nanodiamonds.

EXAMPLE 2

A base oil consisting of a commercial synthetic 5W30 motor oil, is poured into a mixing vessel and is agitated at a low speed of 2200 RPM using a Silverson L4RT laboratory mixer. 18 ppm of UDD 90 nanodiamonds is added to the mixing vessel along with 550 ppm of water. The agitation rate is increased to 9400 RPM and is maintained for 25 minutes. During that time, the RPM increased from about 9400 to about 10,200 RPM due to internal heating. The mixing vessel is then transferred to the Hielscher UP1000 ultrasonic processor and ultrasonicated at a frequency of 20 kHz and an amplitude of 25 microns for 15 minutes. Following ultrasonication, no observable particles are present in a sample of the mixture drawn up into a glass pipette and no nanodiamonds are observed settling out onto the bottom of the mixing vessel. The product is a light amber to amber green.

EXAMPLE 3

A base oil consisting of a commercial synthetic 5W30 motor oil, is poured into a mixing vessel and is agitated at a low speed of 2200 RPM using a Silverson L4RT laboratory mixer. 105 ppm of UDD 90 nanodiamonds is added to the vessel along with 1667 ppm of water. The agitation rate is increased to 9400 RPM and is maintained for 25 minutes. During that time, the RPM increased from about 9400 to about 10,200 RPM due to internal heating. The mixing vessel is then transferred to the Hielscher UP1000 ultrasonic processor and ultrasonicated at a frequency of 20 kHz and an amplitude of 25 microns for 15 minutes. Following ultrasonication, no observable particles are present in a sample of the mixture drawn up into a glass pipette and no nanodiamonds are observed settling out onto the bottom of the mixing vessel. The product is a dark green similar to Example 1 but the tint is less black and more true green.

Figure 7:
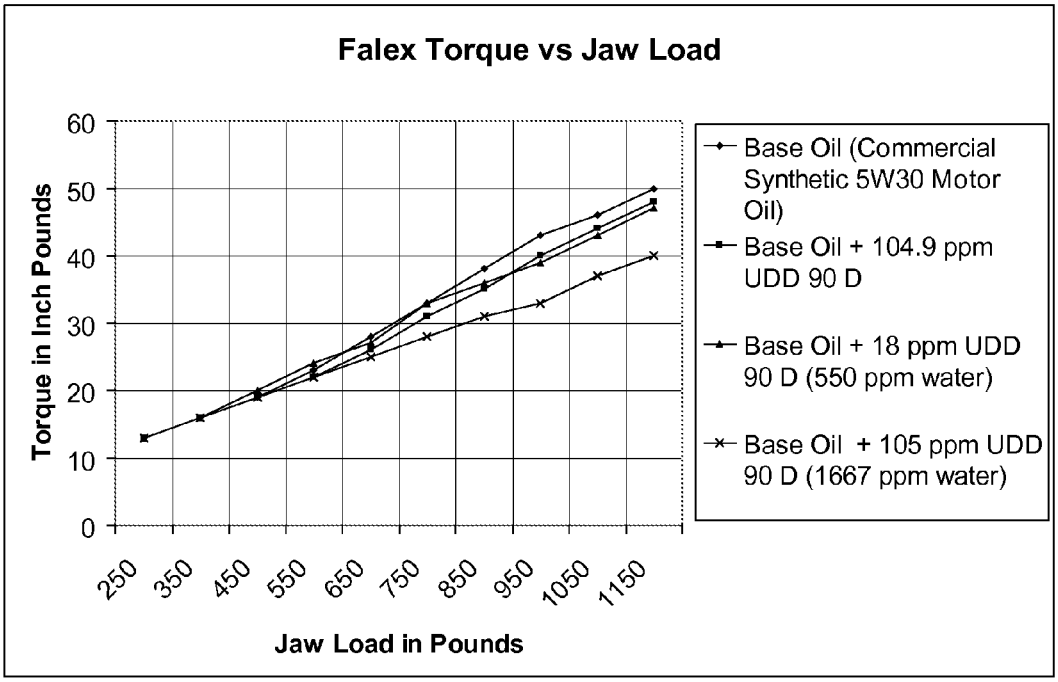
FIG. 7 is a graph depicting Falex Torque results for a variety of different lubricant compositions.

To assess the lubricating ability of the foregoing exemplary lubricating compositions, they may be subjected to Falex frictional testing in accordance with ASTM D3233. The Falex test measures the increase in frictional torque with increasing jaw load on pin and vee block machine. FIG. 7 depicts Falex Torque versus Jaw Load results for a modified "step" ASTM D3233 procedure in which the jaw load is increased from 250 pounds to 1150 pounds in increments of 100 pounds for the base oil used in Examples 1-3 and the lubricating compositions of Examples 1-3. The data for Examples 1 and 3 shows that above jaw loads of about 674 lbs, the addition of 1667 ppm of water produces a significant reduction in friction. The data for Examples 1 and 2 shows that the addition of 550 ppm of water allows the nanodiamond content of the lubricating composition to be significantly reduced without compromising lubricating performance. While some commercial oils have a water content ranging from 150 ppm to 200 ppm, water is generally believed to be an undesirable impurity. However, it is believed that use of additional water increases the friction reducing properties of the nanodiamonds.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A method of making a lubricant composition, comprising:

combining a lubricating fluid, an added amount of water, and carbon nanoparticles, wherein the carbon nanoparticles include nanodiamonds; and mixing the combination of lubricating fluid, water, and carbon nanoparticles to produce a mixture of lubricating fluid, water, and carbon nanoparticles, wherein the lubricating fluid comprises a blend of API Group III and API Group IV base stocks, the blend comprises 82.1% by weight of the lubricating fluid, the lubricating fluid has a kinematic viscosity of 10.8 cSt at 100° C. and a kinematic viscosity of 62 cSt at 40° C., the amount of water in the mixture ranges from about 550 ppm to about 1667 ppm by weight of the mixture, the carbon nanoparticles comprise about 90 percent nanodiamonds by weight of the carbon nanoparticles, and the amount of carbon nanoparticles in the mixture ranges from about 18 ppm to about 104.9 ppm by weight of the mixture.

* * * * *